US006886922B2

(12) United States Patent
Hirasawa et al.

(10) Patent No.: US 6,886,922 B2
(45) Date of Patent: May 3, 2005

(54) LIQUID DISCHARGE HEAD AND MANUFACTURING METHOD THEREOF

(75) Inventors: Taku Hirasawa, Kyoto (JP); Akiko Murata, Osaka (JP); Atsushi Tomozawa, Osaka (JP); Eiji Fujii, Osaka (JP); Hideo Torii, Osaka (JP); Ryoichi Takayama, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/606,977

(22) Filed: Jun. 26, 2003

(65) Prior Publication Data

US 2004/0017442 A1 Jan. 29, 2004

(30) Foreign Application Priority Data

Jun. 27, 2002 (JP) ..... 2002-187644

(51) Int. Cl.[7] ..... B41J 2/045
(52) U.S. Cl. ..... 347/68; 347/70
(58) Field of Search ..... 347/68, 70, 71, 347/72; 437/68, 70, 71, 72; 427/304, 305; 430/320

(56) References Cited

U.S. PATENT DOCUMENTS 3,664,860 A * 5/1972 Kamiya et al. ..... 427/305
6,306,562 B1 * 10/2001 Ikeda et al. ..... 430/320

FOREIGN PATENT DOCUMENTS

| | | | | |
|---|---|---|---|---|
| EP | 0 867 287 A1 | | 9/1998 | |
| EP | 0 930 168 A1 | | 7/1999 | |
| JP | 57188664 A | * | 11/1982 | ..... C23C/3/02 |
| JP | 61185453 | | 8/1986 | |
| JP | 09300634 A | | 11/1997 | |
| JP | 10286953 A | | 10/1998 | |
| JP | 2001047626 A | | 2/2001 | |
| JP | 2001324505 A | | 11/2001 | |

OTHER PUBLICATIONS

European Search Report for Application No. 03014750; Mailing Date: Sep. 29, 2003.

* cited by examiner

*Primary Examiner*—Hai Pham
(74) *Attorney, Agent, or Firm*—Harness, Dickey & Pierce, P.L.C.

(57) ABSTRACT

In the liquid discharge head for discharging liquid such as ink like the ink jet head, at least a part on a surface of a piezoelectric element on the side of a liquid chamber member (ink chamber member) is composed of a nucleus forming assistance material contained layer containing a material for assisting nucleus forming for growth of plating at the time of forming the liquid chamber member on the surface by means of the electroless plating, and the liquid chamber member is formed on the nucleus forming assistance material contained layer by the electroless plating.

12 Claims, 8 Drawing Sheets

LIQUID DISCHARGE HEAD AND MANUFACTURING METHOD THEREOF

BACKGROUND OF THE INVENTION

The present invention relates to a liquid discharge head for discharging liquid, such as an ink jet head for discharging ink, and a manufacturing method thereof.

Conventionally, as an ink jet head to be used in an ink jet type recording apparatus, the ink jet head having a piezoelectric element is known. The piezoelectric element is constituted so that a piezoelectric layer, two electrode layers and a diaphragm layer are laminated (in some piezoelectric elements, the diaphragm layer serves also as one electrode layer). The piezoelectric layer is made of lead zirco-titanate (PTZ) or the like. The electrode layers are provided on both surfaces of the piezoelectric layer in a thickness direction. The diaphragm layer is provided on one of the electrode layers. When voltage is applied to between the electrode layers and a piezoelectric element expands and contracts to a direction vertical to a laminating direction (thickness direction), the expansion and contraction is constrained by the diaphragm layer so that the piezoelectric element is deflected towards an ink chamber into a convex shape so as to be deformed. Pressure is generated in the ink chamber due to the deflective deformation, and the pressure discharges the ink in the ink chamber from a nozzle hole connected with the ink chamber to the outside.

As a method for manufacturing the above ink jet head, for example, Japanese Patent Application Laid-Open No. 10-286953 (1998) suggests a method for forming one electrode film of both electrodes (individual electrode film), a piezoelectric film, the other electrode film (common electrode film) and a diaphragm film successively on a substrate made of MgO by means of sputtering or the like, and aligning and jointing an ink chamber member having an ink chamber hole for composing an ink chamber to the diaphragm film of the piezoelectric element using an adhesive, and removing the deposit substrate by means of etching. According to this manufacturing method, the respective layers are formed on the substrate having a size for a plurality of ink jet heads so that many compact ink jet heads can be manufactured together.

In a method for manufacturing an ink jet head disclosed in, for example, Japanese Patent Application Laid-Open No. 2001-47626, a monocrystal silicon substrate is worked so as to be an ink chamber member, and a piezoelectric element is formed directly on the substrate without using an adhesive.

As a method for forming the ink chamber member, for example, Japanese Patent Application Laid-Open No. 9-300634 (1997) discloses a method for forming the ink chamber member directly on a diaphragm according to electroforming (electroplating) using a dry film resist made of a photosensitive material as a mold.

In recent years, a liquid discharge head having the same structure as the ink jet head, which discharges various kinds of liquid instead of ink, is known. For example, in Japanese Patent Application Laid-Open No. 2001-324505, a biopolymer solution of DNA, protein or the like is discharged from a nozzle hole of the liquid discharge head onto a substrate, so that a biochip is manufactured by an ink jet system.

In the case where the liquid discharge head for discharging the liquid such as ink like the ink jet head is manufactured, the method disclosed in Japanese Patent Application Laid-Open No. 10-286953 (1998) requires the step of jointing a liquid chamber member (corresponding to the ink chamber member of the ink jet head) to a diaphragm film using an adhesive. In the method disclosed in Japanese Patent Application Laid-Open No. 2001-47626, since Young's modulus of silicon is 160 GPa which is very low, when the nozzle and the liquid chamber (ink chamber) are arranged with high density, crosstalk (the discharge properties change due to influence of the diaphragm layer and vibration of liquid in another liquid chambers) easily occurs between plural liquid chambers (particularly adjacent liquid chambers).

In order that the joint step is eliminated and the liquid chamber member is made of a material with high Young's modulus, as disclosed in Japanese Patent Application Laid-Open No. 9-300634 (1997), it is considered that the liquid chamber member is formed on the diaphragm layer by the electroforming.

The electroforming, however, causes a problem such that dispersion of a thickness of the liquid chamber member becomes large. For this reason, in the case where the piezoelectric element is formed on the substrate with large area for enabling the many liquid discharge heads to be manufactured together and the liquid chamber member is formed on the piezoelectric element, the thickness of the liquid chamber member is greatly different between a portion corresponding to a peripheral edge and a portion corresponding to a center of the substrate. As a result, in the case where the liquid chamber member is divided into individual liquid discharge heads, the liquid discharge properties such as a liquid discharge speed and the like differ between the liquid discharge heads. It is, therefore, very difficult to mass-produce the liquid discharge heads using the electroforming.

SUMMARY OF THE INVENTION

In view of the above-mentioned conventional problems, the present invention has been devised for the purpose of enabling a liquid chamber member to be formed directly on a piezoelectric element without using an adhesive and simultaneously suppressing occurrence of crosstalk, and making a thickness of the liquid chamber member uniform so as to manufacture many liquid discharge heads together without dispersion of liquid discharge properties.

In order to achieve the above object, in the present invention, the liquid chamber member is formed on the piezoelectric element by electroless plating.

Concretely, a liquid discharge head of the present invention includes: liquid chambers for housing liquid; a piezoelectric element configured so that a plurality of layers including a piezoelectric layer, an electrode layer and a diaphragm layer are laminated, the piezoelectric element being deformed to a laminating direction so that a capacity of the liquid chambers is reduced and discharging the liquid in the liquid chambers; and a liquid chamber member made of an electroless plating material provided on one side of the piezoelectric element in the laminating direction, the liquid chamber member having liquid chamber holes for composing the liquid chambers opened on a side of the piezoelectric element and a surface opposite to the piezoelectric element, wherein at least a part on the surface of the piezoelectric element on the side of the liquid chamber member is composed of a nucleus forming assistance material contained layer containing a material for assisting nucleus forming for growth of plating at the time of forming the liquid chamber member on the surface by means of the electroless plating.

According to the above structure, since the surface of the piezoelectric element on the side of the liquid chamber member contains the material for assisting the nucleus forming for the growth of the plating, the piezoelectric element is subject to the electroless plating, so that the nucleus for the growth of the plating is formed by the material. The nucleus grows the plating, and thus the liquid chamber member can be formed directly on the piezoelectric element without using an adhesive. When the liquid chamber member is formed by the electroless plating in such a manner, a forming speed is slightly inferior to electroforming, but a thickness of the liquid chamber member can be uniform. As a result, the many liquid discharge heads can be manufactured together without dispersion of liquid discharge properties. The liquid chamber member can be formed by a material (Ni or the like) with high Young's modulus (not less than 200 GPa), thereby suppressing occurrence of crosstalk. The liquid chamber member formed by the electroless plating is proof against alkali and has lower thermal expansion coefficient in comparison with the liquid chamber member formed by electroplating. As a result, the liquid chamber member makes it possible to improve the resistance to alkaline ink generally including phosphorus or the like and, also, to suppress the change of liquid discharge properties due to a change in temperature. Hardness (Young's modulus) of the liquid chamber member can be heightened by heat treatment. As a result, the liquid chamber member hardly deforms at the time of an operation of the piezoelectric element, so that the occurrence of crosstalk is suppressed securely and the liquid discharge properties can be stabilized.

In the above liquid discharge head, it is desirable that the nucleus forming assistance material contained layer is patterned correspondingly to a position of the liquid chamber member other than the liquid chamber holes.

As a result, the plating grows on the patterned nucleus forming assistance material contained layer so that a side wall of the liquid chamber holes can be formed. Since the plating does not grow on the portion where the nucleus forming assistance material contained layer do not exist, the liquid chamber holes can be formed. When molds are formed on the portion where the nucleus forming assistance material contained layer do not exist, the liquid chamber holes can be formed into an accurate shape by the molds.

It is preferable that the material for assisting the nucleus forming is metal having catalysis with respect to reduction reaction of the plating material. When the plating material is Ni, the metal having catalysis is at least one selected from a group of Ni, Fe and Pd. Such metal functions as catalyst, so that the plating material separates out so as to be the nucleus, and the plating is grown by the nucleus. The liquid chamber member can be, therefore, obtained by the electroless plating.

The material for assisting the nucleus forming may be the metal having larger ionization tendency than the plating material. When the plating material is Ni, the metal having the larger ionization tendency than the plating material may be at least one selected from a group of Ti, Mg, Al and Zn. Such metal is eluted at an early state of the electroless plating, and the plating material separates out due to replacement reaction with the metal so as to become the nucleus. The plating is grown due to the nucleus. Similarly to the case where the material for assisting the nucleus forming is the metal having the catalysis, therefore, the liquid chamber member can be obtained securely by the electroless plating.

In the above liquid discharge head, it is preferable that the entire surface of the piezoelectric element on the side of the liquid chamber member is composed of the nucleus forming assistance material contained layer.

As a result, the nucleus forming assistance material contained layer can be formed easily by a sputtering method or the like, and the molds are formed on the portions on the nucleus forming assistance material contained layer corresponding to the liquid chamber holes, so that the liquid chamber member can be formed easily and accurately.

When an entire surface of the piezoelectric element on the side of the liquid chamber member is composed of the nucleus forming assistance material contained layer, it is preferable that the diaphragm layer contains the material for assisting the nucleus forming so as to serve also as the nucleus forming assistance material contained layer.

As a result, it is not necessary to provide the nucleus forming assistance material contained layer singularly, so that the manufacturing cost can be further reduced.

A method for manufacturing a liquid discharge head of the present invention includes: the laminate forming step of laminating at least the piezoelectric layer, the electrode layer and the diaphragm layer so as to form a laminate on a substrate; the liquid chamber member forming step of forming a liquid chamber member on a surface of the laminate opposite to the substrate by means of electroless plating, the liquid chamber member having liquid chamber holes for composing the liquid chambers being opened on a side of the laminate and a surface opposite to the laminate; and the substrate removing step of removing the substrate after the liquid chamber member forming step.

As a result, since the liquid chamber member is formed on the surface of the laminate opposite to the substrate by the electroless plating, the liquid discharge head can be obtained easily.

In the above manufacturing method, it is preferable that the liquid chamber member forming step includes: the mold forming step of forming molds which are patterned correspondingly to positions of the liquid chamber holes of the liquid chamber member on the surface of the laminate opposite to the substrate; the side wall forming step of forming a side wall of the liquid chamber holes on the liquid chamber member on a portion on the surface of the laminate opposite to the substrate where the molds do not exist by means of electroless plating; and the liquid chamber hole forming step of removing the molds after the side wall forming step so as to form the liquid chamber holes.

As a result, the patterned molds are formed on the surface of the laminate opposite to the substrate, and the side wall of the liquid chamber holes is formed on the portion where the molds do not exist by the electroless plating. The molds are, thereafter, removed so that the liquid chamber holes are formed, thereby forming the liquid chamber member. When such molds are, therefore, formed, all the liquid chamber holes can be formed into an accurate shape, the dispersion of the liquid discharge properties can be suppressed more satisfactorily.

In the above manufacturing method, it is preferable that the molds are formed by photosensitive resist. As a result, the patterned molds can be formed on the surface of the laminate opposite to the substrate easily and accurately.

When the liquid chamber member forming step includes the mold forming step, the side wall forming step and the liquid chamber hole forming step, after the mold forming step, a nucleus forming assistance material contained layer containing a material for assisting nucleus forming for growth of the plating at the time of forming the liquid chamber member by means of the electroless plating is formed on a portion on the surface of the laminate opposite to the substrate where the molds do not exist, and at the side wall forming step, the side wall of the liquid chamber holes are formed on the nucleus forming assistance material contained layer by the electroless plating.

As a result, the liquid chamber member can be formed on the surface of the laminate opposite to the substrate where the molds do not exist easily and securely by the electroless plating.

It is preferable that the material for assisting the nucleus forming is metal having catalysis with respect to reduction reaction of a plating material or metal having larger ionization tendency than the plating material. When the plating material is Ni, the metal having catalysis may be at least one selected from a group of Ni, Fe and Pd. When the plating material is Ni, the metal having the larger ionization tendency than the plating material may be at least one selected from a group of Ti, Mg, Al and Zn.

In the above manufacturing method, at the laminate forming step, the entire surface of the laminate opposite to the substrate is preferably composed of a nucleus forming assistance material contained layer containing a material for assisting nucleus forming for growth of the plating at the time of forming the liquid chamber member by means of the electroless plating, and at the liquid chamber forming step, the liquid chamber member is preferably formed on the surface of the laminate opposite to the substrate by the electroless plating.

As a result, the liquid discharge head, in which the entire surface of the piezoelectric element on the side of the liquid chamber member is composed of the nucleus forming assistance material contained layer, can be obtained easily.

At the laminate forming step, when the entire surface of the laminate opposite to the substrate is composed of the nucleus forming assistance material contained layer, the entire surface of the laminate opposite to the substrate may be composed of a diaphragm layer which contains the material for assisting the nucleus forming so as to serve also as the nucleus forming assistance material contained layer.

DETAILED DESCRIPTION OF THE INVENTION

Hereinafter, preferred embodiments of the present invention will be described with reference to the accompanying drawings.

Embodiment 1

Figure 1:
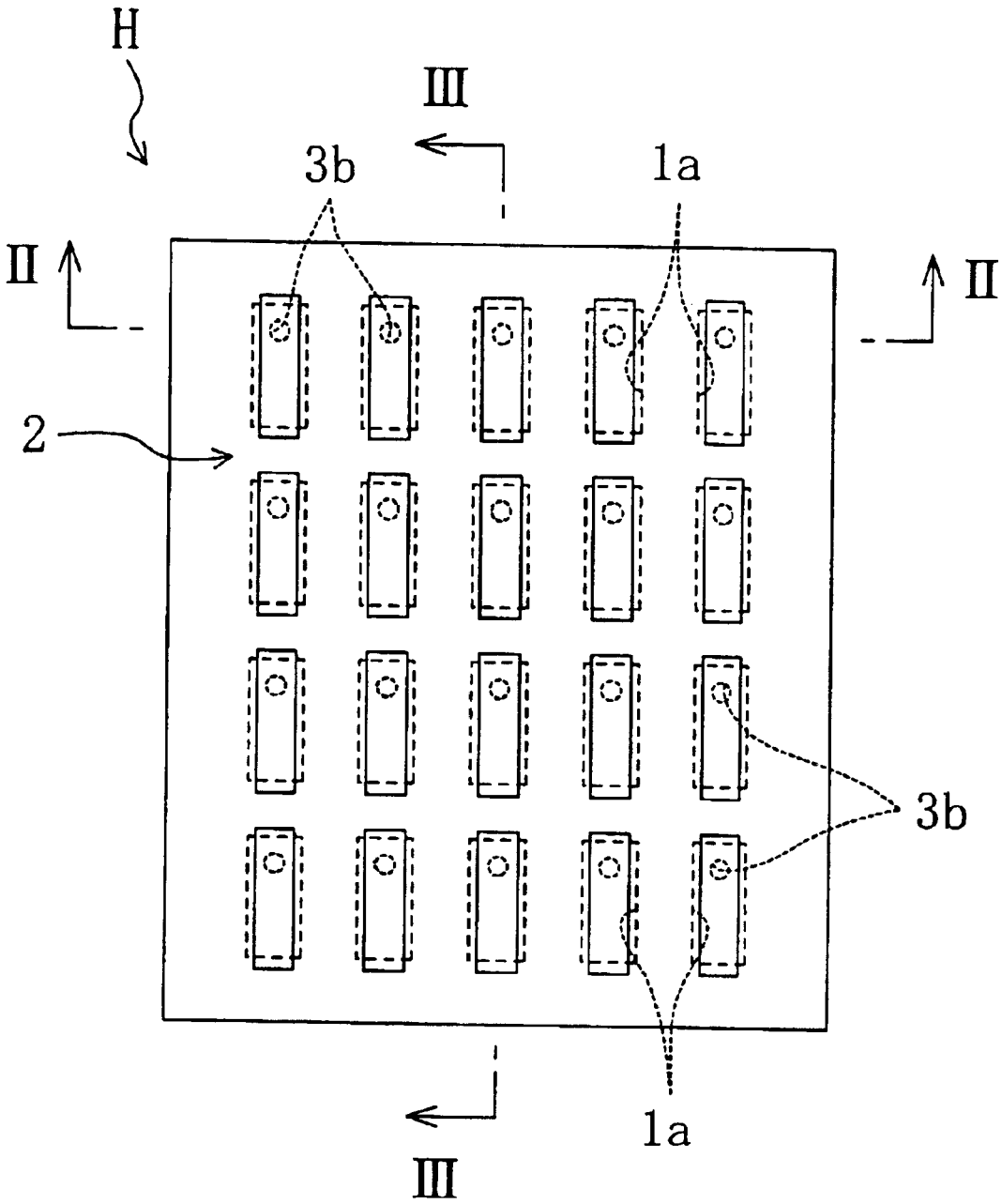
FIG. 1 is a plan view showing an ink jet head as a liquid discharge head in the first embodiment of the present invention.
Figure 2:
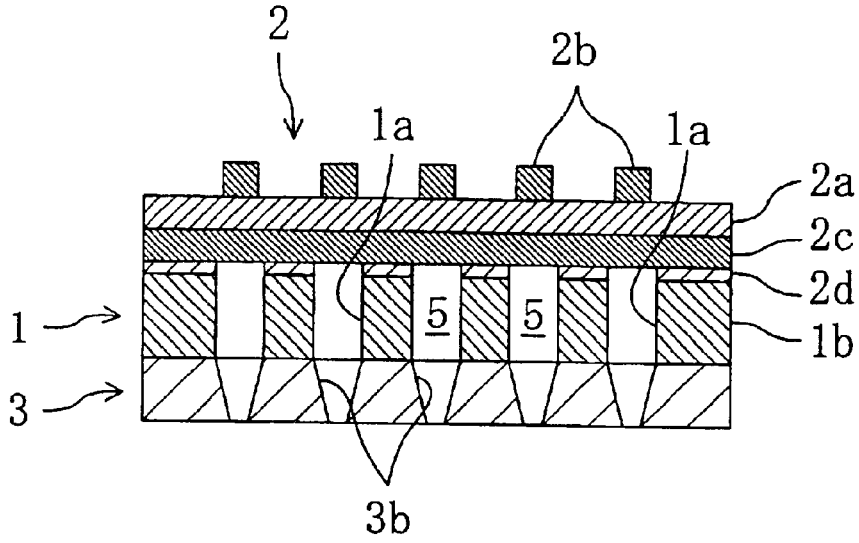
FIG. 2 is a sectional view taken along line II—II of FIG. 1.
Figure 3:
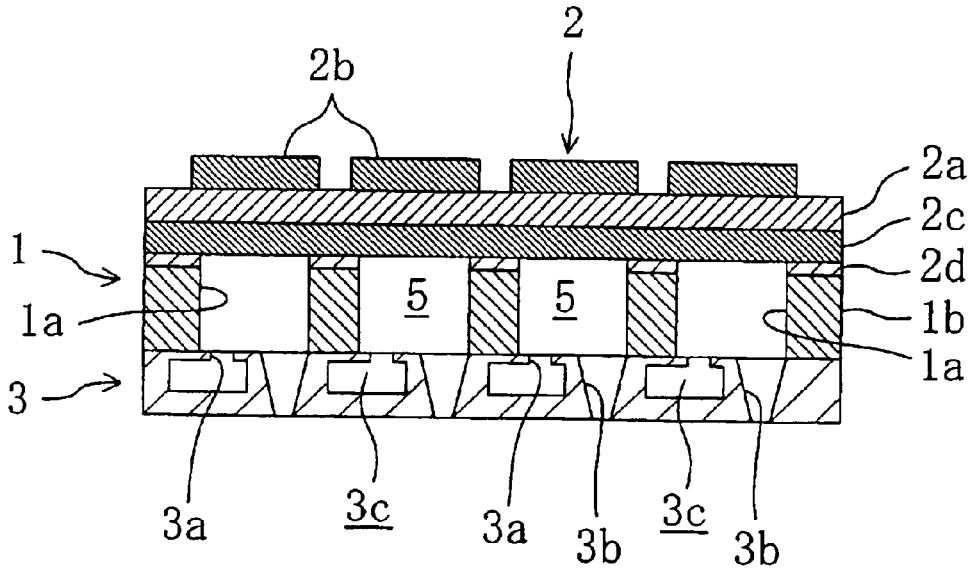
FIG. 3 is a sectional view taken along line III—III of FIG. 1.
Figure 4:
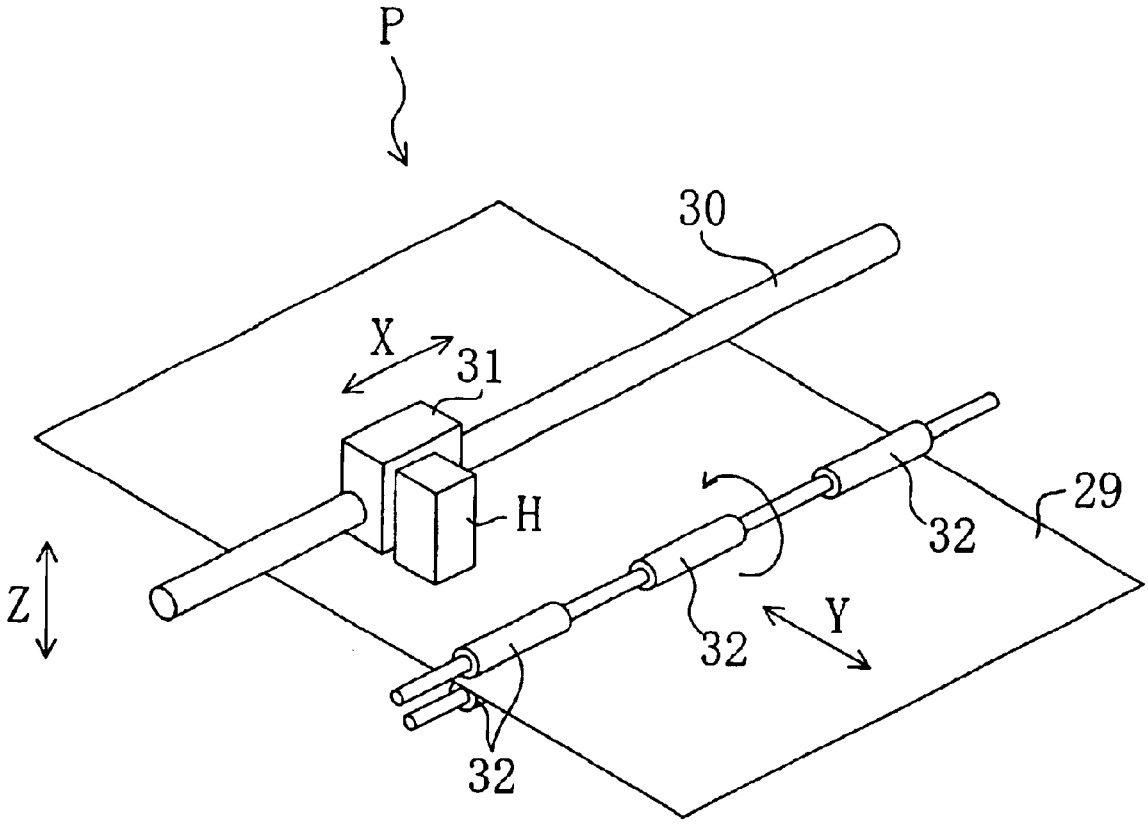
FIG. 4 is a schematic diagram showing an ink jet type recording apparatus mounted with the ink jet head of FIG. 1.

FIGS. 1 through 3 show an ink jet head H as a liquid discharge head in the first embodiment of the present invention, and the ink jet head H is mounted to an ink jet type recording apparatus P shown in FIG. 4. The ink jet head H is constituted so that ink (liquid) in ink chambers 5 (liquid chambers), mentioned later, is discharged from nozzle holes 3*b* provided to be connected with the ink chambers 5 onto a recording medium 29 (recording sheet or the like) and recording is carried out.

The ink jet head H is mounted on a carriage 31 provided on a carriage shaft 30 which extends to the primary scanning direction X, and the carriage 31 reciprocates along the carriage shaft 30 and accordingly the ink jet head H reciprocates to the primary scanning direction X. As a result, the carriage 31 composes a relative moving unit which relatively moves the ink jet head H and the recording medium 29 to the primary scanning direction X.

The ink jet type recording apparatus P has a plurality of rollers 32 which move the recording medium 29 to the secondary scanning direction Y which is approximately vertical to the primary scanning direction X (width direction) of the ink jet bead H. As a result, the rollers 32 compose the relative moving unit which relatively moves the ink jet head H and the recording medium 29 to the secondary scanning direction Y In FIG. 4, Z is an up-down direction.

When the ink jet head H is moving to the primary scanning direction X by means of the carriage 31, it discharges the ink from the nozzle holes 3*b* of the ink jet head H onto the recording medium 29. When the recording for one scanning is completed, the rollers 32 move the recording medium 29 by a predetermined quantity so that next recording for one scanning is carried out.

The ink jet head H has an ink chamber member 1 (liquid chamber member) with a thickness of 30 to 50 $\mu$m, a piezoelectric element 2 configured by laminating a plurality of layers, and a nozzle plate 3. The ink chamber member 1 is provided on one side of the piezoelectric element 2 in a laminating direction (thickness direction). The ink chamber member 1 has a plurality of ink chamber holes 1*a* (liquid chamber holes) which are opened into approximately rectangular shape on both surfaces of the ink chamber member 1 in the thickness direction (surface on the side of the piezoelectric element 2 (upper surface) and a surface opposite to the piezoelectric element 2 (lower surface)). The ink chamber holes 1*a* are arranged in a plurality of lines (four lines in FIG. 1), and the ink chamber holes 1*a* in each line are arranged with predetermined intervals in the width direction. A portion of the ink chamber member 1 other than the ink chamber holes 1*a* composes a side wall 1*b* of the ink chamber holes 1*a*. The ink chamber member 1 is made of an Ni electroless plating material. That is to say, as detailed in a manufacturing method, mentioned later, the ink chamber member 1 is formed by electroless-plating a surface of the piezoelectric element 2 on the side of the ink chamber member 1 with Ni. A material (plating material) of the ink chamber member 1 is not limited to Ni, and another materials may be used, but metal such as Cr, Mo or Co or metal alloy with Young's modulus of not less than 200 GPa is preferable. Particularly Ni is the most preferable because its Young's modulus is not less than 200 GPa, a forming speed is fast (about 15 μm/h) and a thickness is sufficient for the ink chamber member 1 (30 to 50 μm).

The one surface of the ink chamber member 1 in the thickness direction (upper surface) is covered with the piezoelectric element 2, whereas the other surface (lower surface) is covered with the nozzle plate 3 jointed to the other surface by means of an adhesive. The ink chamber holes 1*a* of the ink chamber member 1, the piezoelectric element 2 and the nozzle plate 3 compose a plurality of ink chambers 5 charged with ink.

The nozzle plate 3 has a plurality of supply ink flow passages 3*a* and nozzle holes 3*b* connected with openings on lower sides of the ink chamber holes 1*a* of the ink chamber member 1. Each of the supply ink flow passages 3*a* is connected with ink supply chambers 3*c* provided on each of lines of the ink chamber holes 1*a* and extending to a direction in which the ink chamber holes 1*a* in each line are arranged, and each of the ink supply chambers 3*c* is connected with an ink tank, not shown. On the other hand, the nozzle holes 3*b* are formed so that their diameter becomes smaller downward, and the ink in the ink chambers 5 are discharged from the nozzle holes 3*b* to the outside (the recording medium 29).

The piezoelectric element 2 is configured so that a piezoelectric layer 2*a* made of PZT, individual electrode layers 2*b*, a diaphragm layer 2*c* and a nucleus forming assistance material contained layer 2*d* are laminated. The individual electrode layers 2*b* are patterned on the one surface (upper surface) of the piezoelectric layer 2*a* correspondingly to the positions of the ink chamber holes 1*a* and is made of Pt. The diaphragm layer 2*c* is provided on the other surface (lower surface) of the piezoelectric layer 2*a* and is made of at least one selected from a group of Cu, Ti, Fe, Ni, Cr, Co, Mo, Pt, Ir and W. The nucleus forming assistance material contained layer 2*d* is provided on a surface of the diaphragm layer 2*c* opposite to the piezoelectric layer 2*a*. That is to say, the piezoelectric element 2 is configured so that the individual electrode layers 2*b*, the piezoelectric layer 2*a*, the diaphragm layer 2*c* and the nucleus forming assistance material contained layer 2*d* are laminated successively from a side opposite to the ink chamber material 1. In the embodiment, the diaphragm layer 2*c* serves also as a common electrode layer for applying voltage to the piezoelectric layer 2*a* together with the individual electrode layers 2*b*. The common electrode layer may be, however, provided between the piezoelectric layer 2*a* and the diaphragm layer 2*c* individually. In the embodiment, the piezoelectric layer 2*a* is not patterned but may be patterned into individual layers so as to have the same shape as the individual electrode layers 2*b*. The material of the individual electrode layers 2*b* is not limited to Pt, and any materials such as Ir may be used as long as they have high heatproof properties and a substrate 11 (see FIGS. 5A through 5D) can be removed by etching as explained in the manufacturing method, mentioned later.

A part on the surface of the piezoelectric layer 2 on the side of the ink chamber member 1 (portion corresponding to the side wall 1*b* of the ink chamber holes 1*a*) is composed of the nucleus forming assistance material contained layer 2*d*, and the rest portion is composed of the diaphragm layer 2*c*. That is to say, the nucleus forming assistance material contained layer 2*d* is patterned correspondingly to the positions other than the ink chamber holes 1*a*, and does not exist on the openings of the ink chamber holes 1*a* on the side of the piezoelectric element 2. The nucleus forming assistance material contained layer 2*d* contains a material which assists nucleus forming for growth of the plating when the ink chamber member 1 is formed by electroless plating. The material for assisting the nucleus forming may be metal having catalysis with respect to reduction reaction of the plating material or metal having larger ionization tendency than the plating material. Concretely, the metal having catalysis with respect to the reduction reaction of the plating material Ni is preferably at least one selected from a group of Ni, Fe and Pd, and Pd is particularly preferable. Meanwhile, the metal having larger ionization tendency than the plating material Ni is preferably at least one selected from a group of Ti, Mg, Al and Zn. The nucleus forming assistance material contained layer 2*d* may contain a material other than the material for assisting the nucleus forming, and may contain both the metal having catalysis and the metal having larger ionization tendency than the plating material.

The piezoelectric element 2 is deformed by applying voltage to the piezoelectric layer 2*a* via the individual electrode layers 2*b* and the diaphragm layer 2*c*, so that the ink in the ink chambers 5 is discharged from the nozzle holes 3*b*. That is to say, when pulse type voltage is applied between the individual electrode layers 2*b* and the diaphragm layer 2*c*, the piezoelectric layer 2*a* contracts to the width direction vertical to the thickness direction by a rising edge of the pulse voltage. On the contrary, the individual electrode layers 2*b*, the diaphragm layer 2*c* and the nucleus forming assistance material contained layer 2*d* do not contract. The portions of the piezoelectric element 2 corresponding to the ink chambers 5, therefore, deflect and deform into a convex shape towards the ink chambers 5 in the laminating direction due to so-called bimetal effect. The deflective deformation generates pressure in the ink chambers 5, and the pressure discharges the ink in the ink chambers 5 from the nozzle holes 3*b* to the outside. The piezoelectric layer 2*a* extends by a falling edge of the pulse voltage and the piezoelectric element 2 returns to its original state. At this time, the ink chambers 5 are charged with the ink from the ink supply chambers 3*c* via the supply ink flow passages 3*a*.

A schematic procedure of the method for manufacturing the ink jet head H will be explained with reference to FIGS. 5A through 5D and FIGS. 6A through 6C. In the following manufacturing method, a plurality of the ink jet heads H are manufactured together.

Figure 5A:
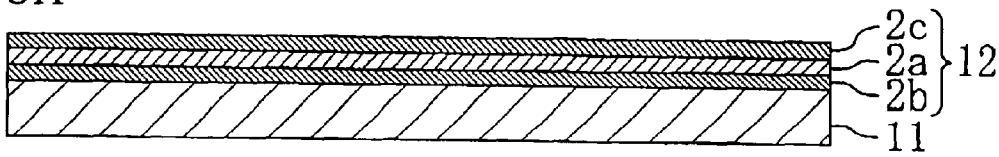
FIGS. 5A through 5D are diagrams showing the laminate forming step, the mold forming step, the nucleus forming assistance material contained layer and side wall forming step and the liquid chamber hole forming step in a method for manufacturing the ink jet head of FIG. 1.

As shown in FIG. 5A, the individual electrode layer 2*b*, the piezoelectric layer 2*a* and the diaphragm layer 2*c* are formed successively on the substrate 11 made of silicon by the sputtering method. A laminate 12, in which the individual electrode layer 2*b*, the piezoelectric layer 2*a* and the diaphragm layer 2*c* are laminated in this order, is formed.

Figure 5B:
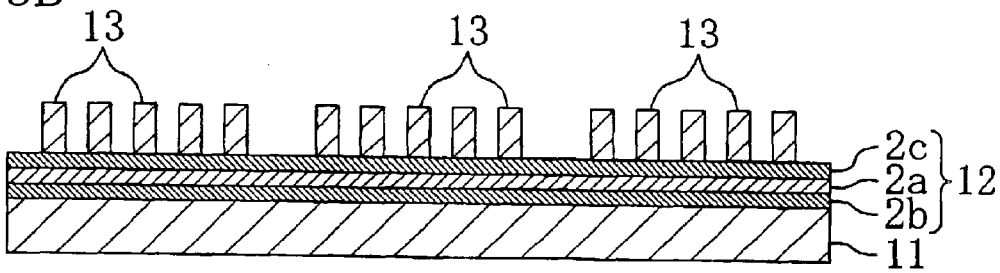

As shown in FIG. 5B, molds 13 which are patterned correspondingly to the positions of the ink chamber holes 1*a* of the ink chamber member 1 are formed on a surface (upper surface) of the laminate 12 opposite to the substrate 11. Concretely, the upper surface of the laminate 12 is coated with photosensitive resist by spin coating, and the resist is exposed by an exposing unit in a state that a mask plate is set on the resist. The molds 13 which are made of the resist and are patterned are formed by developer. The molds 13 may be composed of materials other than the resist, but the resist is preferable because the resist can form the molds 13 patterned on the laminate 12 easily and accurately.

Figure 5C:
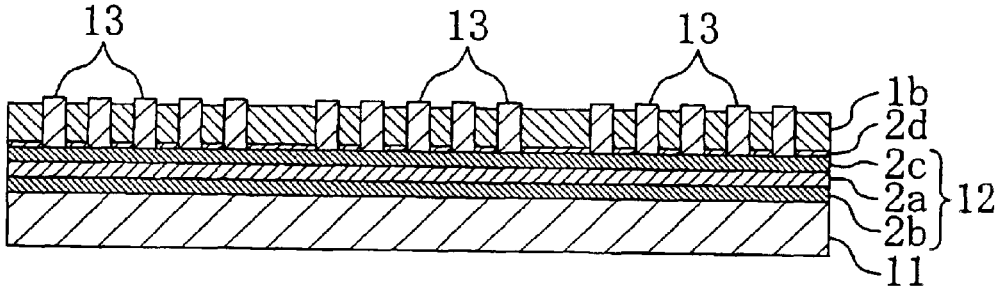

After a naturally oxidized layer is removed from the portion on the upper surface of the laminate 12 where the molds 13 do not exist, as shown in FIG. 5C, the nucleus forming assistance material contained layer 2*d* is formed on the portion on the upper surface of the laminate 12 where the molds 13 do not exist. The nucleus forming assistance material contained layer 2*d* is formed by, for example, immersing the upper surface of the laminate 12 into a solution containing the material for assisting the nucleus forming.

The ink chamber member 1 is, thereafter, formed on the nucleus forming assistance material contained layer 2*d* by the electroless plating. That is to say, the laminate 12 is put into an Ni plating tank, and the side wall 1*b* of the ink chamber holes 1*a* is formed on the portion on the upper surface of the laminate 12 where the molds 13 do not exist via the nucleus forming assistance material contained layer 2*d* by the electroless plating (see FIG. 5C). At this time, in the case where the material for assisting the nucleus forming in the nucleus forming assistance material contained layer 2*d* is the metal having catalysis with respect to the reduction reaction of the plating material, the metal functions as catalysis, and the plating material separates out on the surface of the nucleus forming assistance material contained layer 2*d* so as to be nucleus, so that the plating grows due to the nucleus. Meanwhile, in the case where the material for assisting the nucleus forming is the metal having larger ionization tendency than the plating material, the metal with larger ionization tendency separates out at an early stage of the electroless plating, whereas the plating material separates out on the surface of the nucleus forming assistance material contained layer 2*d* due to substitution reaction with the metal so as to become nucleus, and the plating is grown by the nucleus.

Figure 5D:
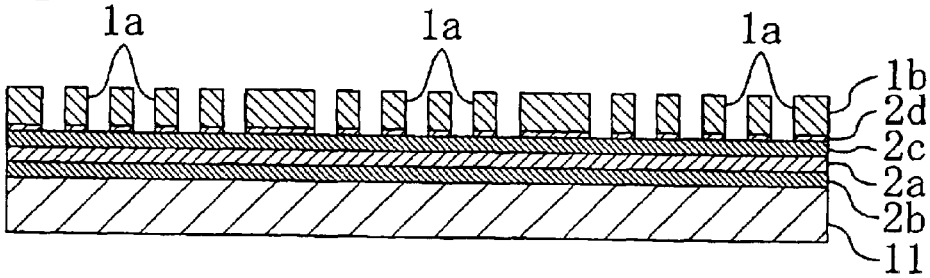

As shown in FIG. 5D, the molds 13 are removed by dry etching so that the ink chamber holes 1*a* are formed. As a result, the ink chamber member 1 is formed on the upper surface of the laminate 12 via the nucleus forming assistance material contained layer 2*d*.

Figure 6A:
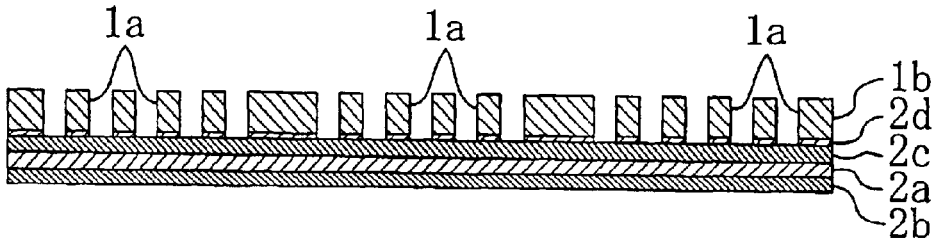
FIGS. 6A through 6C are diagrams showing the substrate removing step, the nozzle plate jointing and individual electrode layers patterning step and the ink jet head dividing step in the method for manufacturing the ink jet head of FIG. 1.

As shown in FIG. 6A, the substrate 11 is removed by etching liquid (KOH solution). Instead of the wet etching, dry etching using $SF_6$, $CF_4$, $C_4F_8$, $Cl_2$ or the like may be used, or the wet etching may be combined with the dry etching. In short, the substrate 11 can be removed by stopping the etching on the individual electrode layer 2*b*.

Figure 6B:
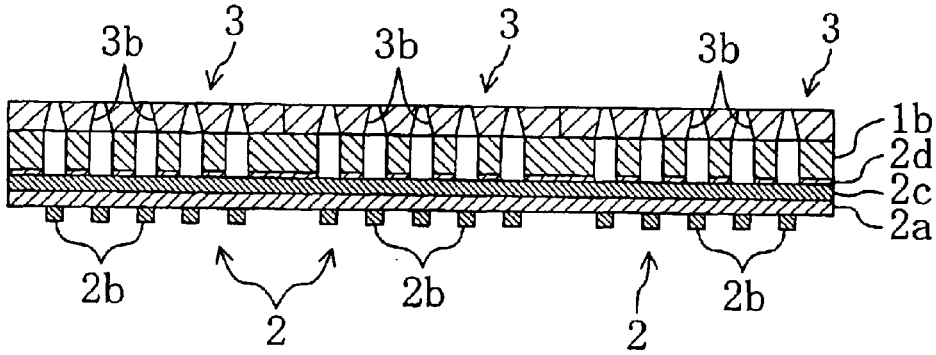

As shown in FIG. 6B, a plurality of the nozzle plate 3 on which the nozzle holes 3*b* or the like are formed in advance is jointed to the surface of the ink chamber member 1 opposite to the laminate 12 by an adhesive, and the individual electrode layers 2*b* are patterned correspondingly to the positions of the ink chamber holes 1*a*. As a result, the piezoelectric element 2 having a predetermined shape corresponding to the ink jet heads H is formed. The joint of the nozzle plates 3 may be carried out first or the patterning of the individual electrode layers 2*b* may be carried out first. After the nozzle plate 3 is jointed to the ink chamber member 1, the substrate 11 is removed, and then the individual electrode layers 2*b* may be patterned.

Figure 6C:
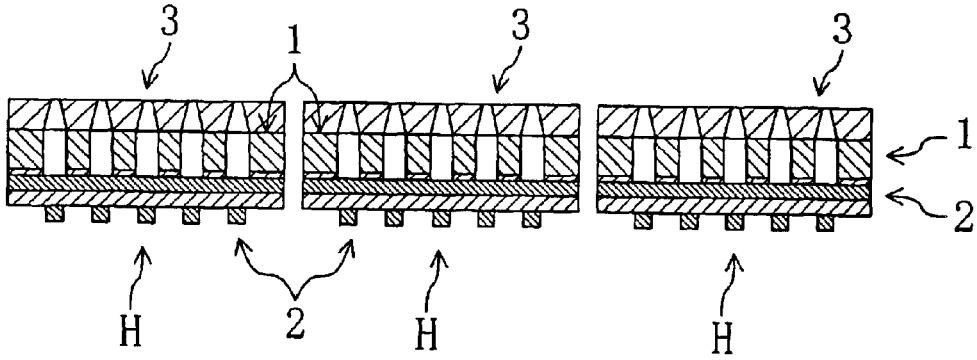

As shown in FIG. 6C, dividing is carried out according to the predetermined shapes of the ink jet heads H, so that the plural ink jet heads H can be obtained together.

In the first embodiment, therefore, the part on the surface of the piezoelectric element 2 on the side of the ink chamber member 1 is composed of the nucleus forming assistance material contained layer 2*d* which contains the material for assisting the nucleus forming for the growth of the plating at the time of forming the ink chamber member 1 is formed on this surface by means of the electroless plating. The ink chamber member 1 is formed on the nucleus forming assistance material contained layer 2*d* by the electroless plating. For this reason, the ink chamber member 1 can be formed directly on the piezoelectric element 2 without an adhesive, and the thickness of the ink chamber member 1 can be more uniform than the electroforming method. As a result, the many ink jet heads H can be manufactured together without dispersion of the ink charging properties, and the productivity can be improved. The ink chamber member 1 can be formed by the material (Ni) with high Young's modulus, and the occurrence of crosstalk can be suppressed. The ink chamber member 1 which is formed by the electroless plating is proof against alkali and has lower thermal expansion coefficient (13 to 14.5 $\mu$m/m•° C.) in comparison with the ink chamber member formed by electroplating. As a result, the liquid chamber member makes it possible to improve the resistance to alkaline ink generally including phosphorus or the like and, also, to suppress the change of liquid discharge properties due to a change in temperature. Hardness (Young's modulus) of the ink chamber member 1 can be heightened by heat treatment (hardness before the heat treatment is Hv 550 to 600 which is equivalent to that of the ink chamber member formed by electroplating). As a result, the ink chamber member 1 hardly deforms at the time of an operation of the piezoelectric element 2, so that the occurrence of crosstalk is suppressed securely and the ink discharge properties can be stabilized.

In the first embodiment, the molds 13 which are patterned correspondingly to the positions of the ink chamber holes 1*a* of the ink chamber member 1 are formed on the upper surface of the laminate 12 so that the ink chamber member 1 is formed. The ink chamber member 1 can be, however, formed without forming the molds 13. That is to say, when the laminate 12 is formed, in addition to the individual electrode layer 2*b*, the piezoelectric layer 2*a* and the diaphragm layer 2*c*, the nucleus forming assistance material contained layer 2*d* is formed on the diaphragm layer 2*c* by the sputtering method, so that the entire upper surface of the laminate 12 is composed of the nucleus forming assistance material contained layer 2*d*. The nucleus forming assistance material contained layer 2*d* is patterned by etching correspondingly to the position of the ink chamber member 1 other than the ink chamber holes 1*a*, and the laminate 12 is put into the plating tank. In this case, if a layer below the nucleus forming assistance material contained layer 2*d* (here, the diaphragm layer 2*c*) does not contain the material for assisting the nucleus forming, the plating does not grow on the layer, and the plating grows only on the nucleus forming assistance material contained layer 2*d*. For this reason, the side wall 1*b* of the ink chamber holes 1*a* is formed on the patterned nucleus forming assistance material contained layer 2*d* by the electroless plating. The ink chamber member 1 can be, therefore, formed without the molds 13.

Embodiment 2

Figure 7:
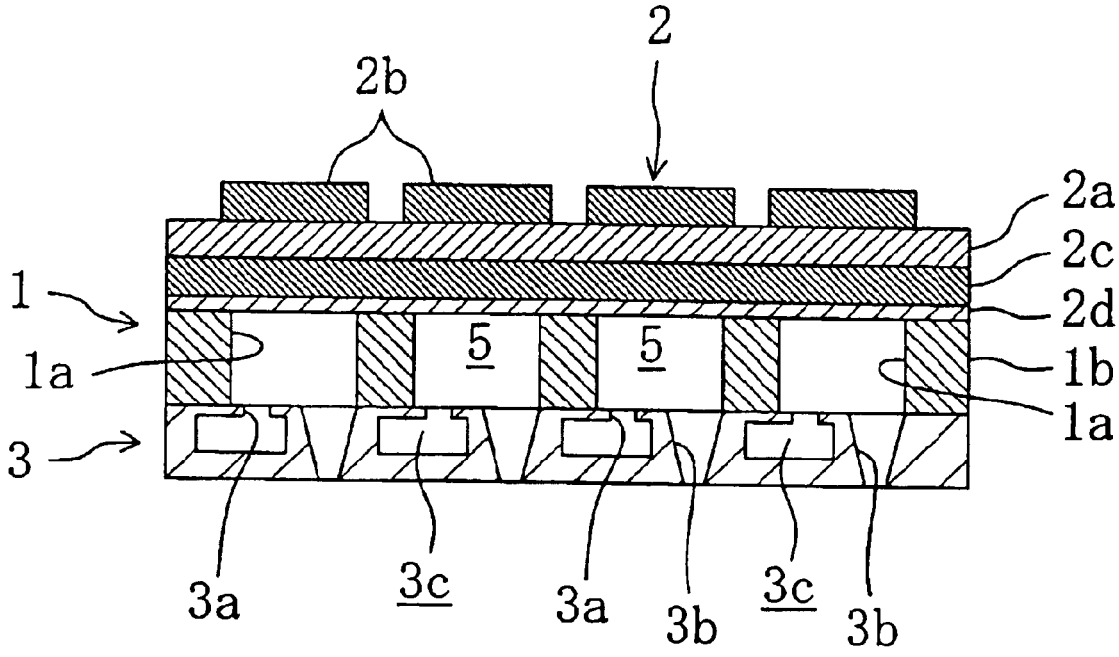
FIG. 7 is a diagram corresponding to FIG. 3 that shows the ink jet head in the second embodiment.

FIG. 7 shows the second embodiment of the present invention (the same parts as in FIGS. 1 through 3 are designated by the same reference numbers, and the detailed explanation thereof will be omitted), and the entire surface of the piezoelectric element 2 on the side of the ink chamber member 1 is composed of the nucleus forming assistance material contained layer 2*d*.

That is to say, in the second embodiment, the nucleus forming assistance material contained layer 2*d* is not patterned and covers the entire surface of the diaphragm layer 2*c* on the side of the ink chamber member 1. The ink chamber member 1 is formed on the nucleus forming assistance material contained layer 2*d* by the electroless plating.

Figure 8A:
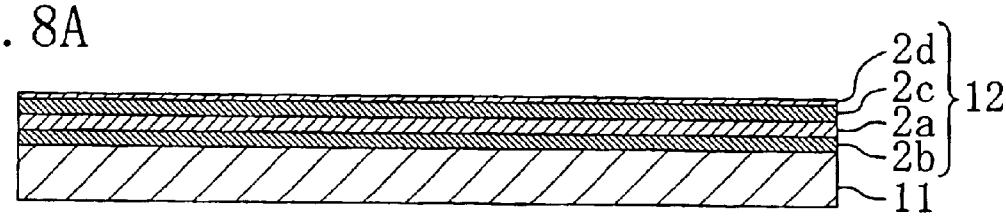
FIGS. 8A through 8D are diagrams showing the laminate forming step, the mold forming step, the side wall forming step and the liquid chamber hole forming step in the method for manufacturing the ink jet head in the second embodiment.

In order to manufacture the ink jet head H, as shown in FIG. 8A, the individual electrode layer 2*b*, the piezoelectric layer 2*a*, the diaphragm layer 2*c* and the nucleus forming assistance material contained layer 2*d* are formed on the substrate 11 successively by the sputtering method, so that the laminate 12, in which the individual electrode layer 2*b*, the piezoelectric layer 2*a*, the diaphragm layer 2*c* and the nucleus forming assistance material contained layer 2*d* are laminated in this order, is formed. That is to say, the entire surface of the laminate 12 opposite to the substrate 1 is composed of the nucleus forming assistance material contained layer 2*d*.

Figure 8B:
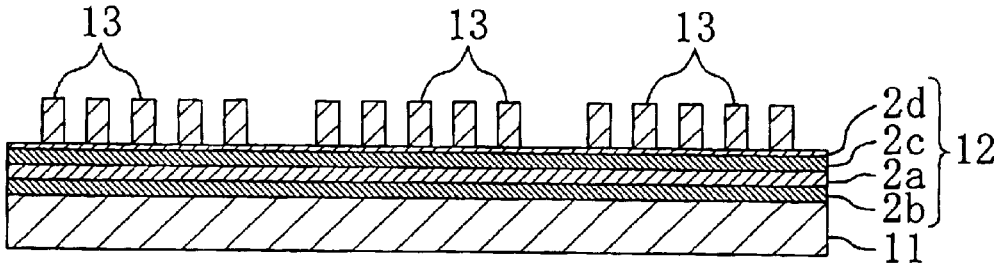
Figure 8C:
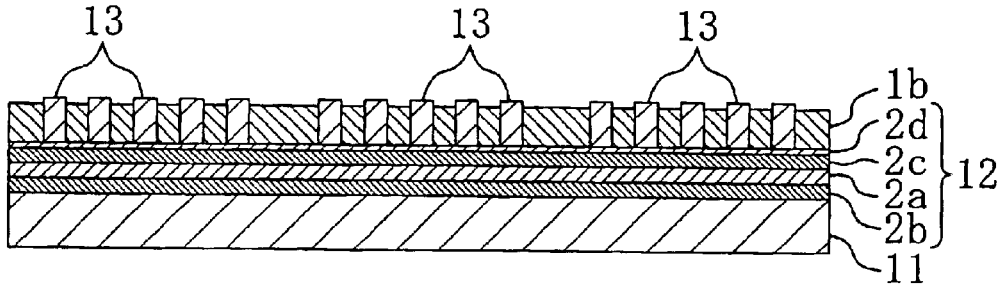
Figure 8D:
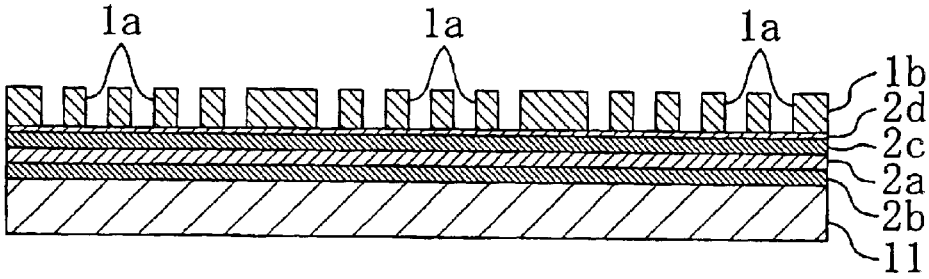

Similarly to the first embodiment, molds 13 which are patterned correspondingly to the positions of the ink chamber holes 1*a* of the ink chamber member 1 are formed on the surface of the laminate 12 opposite to the substrate 1 (on the nucleus forming assistance material contained layer 2*d*) (see FIG. 8B). The side wall 1*b* of the ink chamber holes 1*a*, is thereafter, formed on the portion on the upper surface of the laminate 12 where the molds 13 do not exist by the electroless plating (see FIG. 8C). The molds 13 are removed by the dry etching so that the ink chamber holes 1*a* are formed (see FIG. 8D).

Similarly to the first embodiment, substrate 11 is removed, and the nozzle plate 3 is jointed to the surface of the ink chamber member 1 opposite to the laminate 12. The individual electrode layers 2*b* are patterned correspondingly to the positions of the ink chamber holes 1*a*, and finally the separation is carried out so that the ink jet heads H with predetermined shape are obtained.

In the second embodiment, therefore, the nucleus forming assistance material contained layer 2*d* can be formed easily by the sputtering method, and the manufacturing cost of the ink jet heads H can be further reduced.

Embodiment 3

Figure 9:
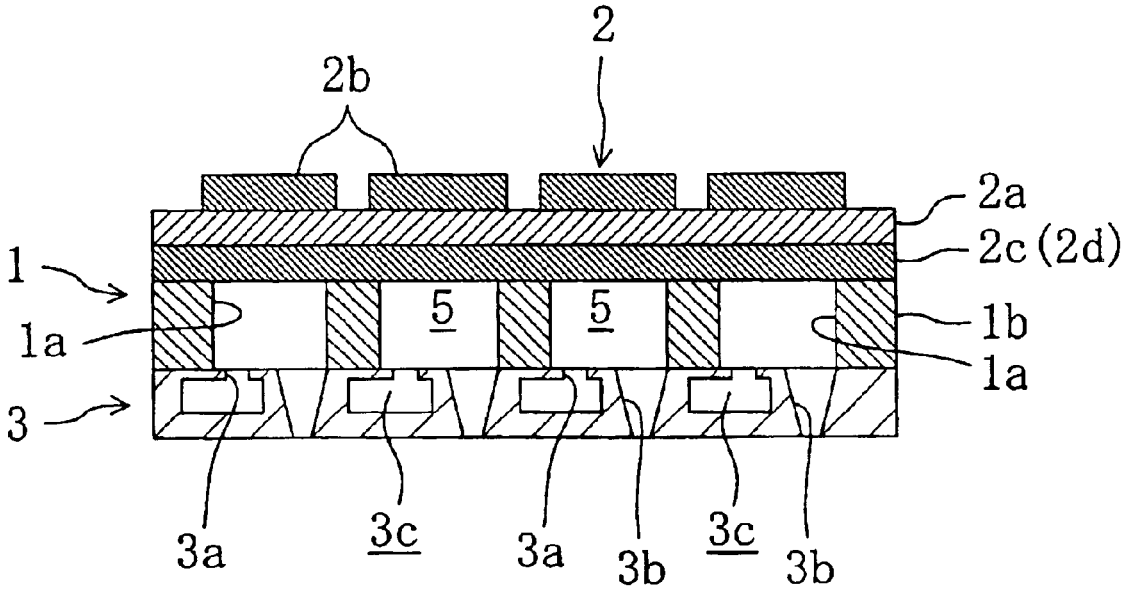
FIG. 9 is a diagram corresponding to FIG. 3 that shows the ink jet head in the third embodiment.

FIG. 9 shows the third embodiment of the present invention, and the diaphragm layer 2*c* serves also as the nucleus forming assistance material contained layer 2*d*.

That is to say, in the third embodiment, the diaphragm layer 2*c* contains the material for assisting the nucleus forming, and the diaphragm layer 2*c* serves also as the nucleus forming assistance material contained layer 2*d*. The entire surface of the piezoelectric element 2 on the side of the ink chamber member 1 is composed of the diaphragm layer 2*c* which serves also as the nucleus forming assistance material contained layer 2*d*.

In order to manufacture the ink jet heads H, the individual electrode layer 2*b*, the piezoelectric layer 2*a* and the diaphragm layer 2*c* are formed on the substrate 11 successively by the sputtering method, so that the laminate 12, in which the individual electrode layer 2*b*, the piezoelectric layer 2*a* and the diaphragm layer 2*c* are laminated in this order, is formed. When the diaphragm layer 2*c* is formed by the sputtering method, the material for assisting the nucleus forming is contained in the diaphragm layer 2*c*. In such a manner, the entire surface of the laminate 12 opposite to the substrate 11 contains the material for assisting the nucleus forming so as to be composed of the diaphragm layer 2*c* which serves also as the nucleus forming assistance material contained layer 2*d*.

Similarly to the first and second embodiments, the molds 13 which are patterned correspondingly to the positions of the ink chamber holes 1*a* of the ink chamber member 1 are formed on the surface of the laminate 12 opposite to the substrate 1 (on the diaphragm layer 2*c*), and the side wall 1*b* of the ink chamber holes 1*a* is formed on the portion on the upper surface of the laminate 12 where the molds 13 do not exist by the electroless plating. The molds 13 are removed by the dry etching so that the ink chamber holes 1*a* are formed.

Similarly to the first and second embodiments, the substrate 11 is removed, and the nozzle plate 3 is jointed to the surface of the ink chamber member 1 opposite to the laminate 12. The individual electrode layers 2*b* are patterned correspondingly to the positions of the ink chamber holes 1*a*, and finally the division is carried out so that the ink jet heads H with predetermined shape are obtained.

In the third embodiment, therefore, it is not necessary to provide the nucleus forming assistance material contained layer 2*d* singularly, so that the manufacturing cost of the ink jet heads H can be further reduced.

In addition to the above ink jet heads, the present invention can be widely applied to the liquid discharge heads for discharging liquid in the similar structure to the ink jet head, such as a liquid discharge head for discharging a biopolymer solution of DNA, protein or the like onto the substrate in order to manufacture a biochip, a liquid discharge head for discharging a metal colloidal solution in order to manufacture a circuit board, a liquid discharge head for discharging an organic semiconductor solution in order to manufacture a display and a liquid discharge head for discharging a dielectric solution in order to manufacture a thin film circuit capacitor and a resistor.

Examples which were carried out concretely will be explained below.

EXAMPLE 1

In the example 1, the ink jet head similar to the first embodiment was manufactured by the similar method to the first embodiment.

Concretely, a Pt film with a thickness of 0.1 $\mu$m was formed as the individual electrode layer on a silicon substrate with a diameter of 4 inches by the sputtering method. At this time, in order to heighten adhesion between the substrate and the Pt film, a substrate temperature at the sputtering was 400° C., and process pressure was 0.5 Pa, and high-frequency power was 100 W.

A PZT film with a thickness of 2 $\mu$m in which a composition ratio of Zr to Ti (Zr/Ti) was 53/47 was formed as the piezoelectric layer on the individual electrode layer. At this time, the substrate temperature at the sputtering was 600° C., and the process pressure was 0.4 Pa and the high-frequency power was 300 W.

A Cu film with a thickness of 5 $\mu$m was formed as the diaphragm layer (serves also as the common electrode layer) on the piezoelectric layer by the sputtering method. At this time, the substrate temperature at the sputtering was 100° C., the process pressure was 1 Pa and the high-frequency power was 400 W. As a result, the laminate was obtained on the substrate.

The diaphragm layer of the laminate was spin-coated with a photosensitive resist (product name: SU-8 50, made by MICRO CHEM) with a thickness of 50 μm by a spin coater (a number of revolution was 2000 rpm), and soft bake (65° C.×6 min, 95° C.×20 min) was carried out. The resist was exposed (for 30 seconds) into shapes of the ink chamber holes by the exposing device of 16 mW/cm$^2$, and post expose bake (65° C.×2 min, 95° C.×5 min) was carried out. Thereafter, development was carried out (developing time: 6 min), so that the molds with a height of 50 μm, a length of 2 mm and a width of 35 μm were formed.

After the naturally oxidized layer on the surface of the diaphragm layer where the molds do not exist was removed by HCl, the surface of the diaphragm layer was immersed into an aqueous solution containing $PdCl_2$, so that the nucleus forming assistance material contained layer made of $PdCl_2$ was formed on the surface of the diaphragm layer.

The laminate is, then, put into the plating tank of Ni heated to 90° C. (product name: Ni 701 made by JAPAN PURE CHEMICAL CO., LTD.), and while density of the plating was being adjusted, the laminate was left there for two hours, so that an electroless plating layer (the side wall 1*b* of the ink chamber holes) was formed on the portion on the laminate where the molds do not exist via the nucleus forming assistance material contained layer. At this time, Pd of the nucleus forming assistance material contained layer functions as catalyst, and thus the plating material (Ni) separated out as the nucleus on the surface of the nucleus forming assistance material contained layer, so that the Ni plating grew on the surface.

The molds were removed by the dry etching using etching gas in which 20% of $CF_4$ was added to $O_2$ so that the ink chamber holes were formed. As a result, the ink chamber member composed of the electroless plating layer was obtained. In order to improve the Young's modulus, the ink chamber member was subject to heat treatment at 400° C. for one hour.

When the thickness of the ink chamber member was measured along the entire portion including portions corresponding to an peripheral edge and a center of the silicon substrate, it was 30 μm±1 μm, and it was found that the thickness was hardly different between the portions corresponding to the peripheral edge and the center of the silicon substrate.

The silicon substrate was etched for five hours in a KOH solution with a temperature of 80° C. and density of 40 wt % so as to be removed completely. The nozzle plate manufactured by a stainless substrate was bonded to the surface of the ink chamber member opposite to the laminate by epoxy resin, so that the individual electrode layers were patterned.

After the completion of the patterning, the ink chambers were charged with ink, and pulse voltage whose maximum voltage was 20 V was applied between the individual electrode layers and the diaphragm layer with a frequency of 20 kHz, so that the ink was discharged from the nozzle holes and the discharge speed of the ink was measured. A difference in the discharge speed between the portions corresponding to the peripheral edge and the center of the silicon substrate was within 3%.

When the pulse voltage whose maximum voltage was 20 V was being applied between the individual electrode layers and the diaphragm layer continuously for 10 days with a frequency of 20 kHz, defective discharge and deterioration of discharge properties of the ink were not seen at all.

When the crosstalk in the ink jet head H in this example was compared with the crosstalk in the ink jet head in which the ink chamber member was formed by silicon, the crosstalk in this example was very lower than that of the ink jet head in which the ink chamber member was formed by silicon. A number of nozzles per one inch was 360 on both the ink jet heads.

EXAMPLE 2

In the example 2, a number of nozzles per one inch was 720 which is twice as many as the example 1 (width of the inside wall of the ink chamber member: 17.5 μm), and the other conditions were the same as those in the example 1.

The pulse voltage whose maximum voltage was 20 V was being applied between the individual electrode layers and the diaphragm layer of the piezoelectric element of the ink jet head continuously for ten days with a frequency of 20 kHz. As a result, brittle fracture did not occur on the side wall of the ink chamber holes on the ink chamber member, and the diaphragm layer and the ink chamber member were not peeled, and defective discharge of the ink and deterioration of the discharge properties were not seen at all.

EXAMPLE 3

In the example 3, the ink jet head similar to the in the second embodiment was manufactured by the similar method to that in the second embodiment. At this time, the nucleus forming assistance material contained layer was composed of Pd and was formed together with the individual electrode layer 2*b*, the piezoelectric layer 2*a* and the diaphragm layer 2*c* by the sputtering method. Similarly to the example 1, in order to improve the Young's modulus, the ink chamber member was subject to the heat treatment at 400° C. for one hour. A number of the nozzles per one inch was 360. As a result, the ink jet head having the similar discharge property to that in the example 1 could be obtained.

In the case where the nucleus forming assistance material contained layer was composed of Ni or Fe (similarly to Pd, metal having catalysis with respect to the reduction reaction of the plating material Ni), and in the case where it was composed of Ti, Mg, Al or Zn (metal having larger ionization tendency than the plating material), the ink jet head having the discharge properties similar to that in the example 1 could be obtained.

EXAMPLE 4

In the example 4, the ink jet head similar to that in the third embodiment was manufactured by the similar method to that in the third embodiment. At this time, the diaphragm layer was composed of metal alloy of Cu and Pd (the content of Pd: 5 atomic %).

Concretely, similarly to the example 1, the individual electrode layer and the piezoelectric layer were formed on the silicon substrate with a diameter of 4 inches successively by the sputtering method, and the diaphragm layer (serves also as the common electrode layer and the nucleus forming assistance material contained layer) was formed on the piezoelectric layer by the sputtering method. The thickness and the sputtering conditions of the diaphragm layer were the same as those in the example 1. As a result, the laminate, in which the entire surface opposite to the substrate is formed of a diaphragm layer serving also as the nucleus assistance material contained layer by containing the material for assisting the nucleus forming (Pd), was obtained.

Similarly to the example 1, the molds with height of 50 μm, length of 2 mm and width of 35 μm were formed on the diaphragm layer of the laminate. After the naturally oxidized layer on the portion of the surface of the diaphragm layer where the molds do not exist was removed by HCl, the laminate was put into the Ni plating tank heated to 90° C., and while density of the plating is being adjusted, the laminate was left therein for two hours. As a result, the electroless plating layer (the side wall of the ink chamber holes) was formed on the portion on the surface of the laminate opposite to the substrate where the molds do not exist. At this time, Pd on the surface of the diaphragm layer functioned as catalyst, and the plating material (Ni) separated out on the surface of the diaphragm layer so as to become the nucleus for the plating growth, and the Ni plating grew on the surface.

The similar working to that in the example 1 was, thereafter, carried out, so that the ink jet head was obtained. In this ink jet head, similarly to the example 1, the thickness of the ink chamber member was 30 μm±1 μm, and the thickness was hardly different between the portion corresponding to the peripheral edge and the portion corresponding to the center of the silicon substrate. The ink chambers were charged with the ink, and pulse voltage whose maximum voltage was 20 V was applied between the individual electrode layers and the diaphragm layer with frequency of 20 kHz, so that the ink was discharged from the nozzle holes. When the discharge speed of the ink was measured, a difference in the discharge speed between the portion corresponding to the peripheral edge and the portion corresponding to the center of the silicon substrate was within 3%.

In the case where the diaphragm layer was composed of metal alloy of Cu and Ni or Fe instead of the metal alloy of Cu and Pd, the same effect as that in the case of the metal alloy of Cu and Pd could be obtained.

EXAMPLE 5

The example 5 was different from the example 4 in that the diaphragm layer was composed of the metal alloy of Pt and Ti (metal with larger ionization tendency than the plating material Ni) (the content of Ti: 5 atomic %). That is to say, in the example 5, when the electroless plating layer (the side wall of the ink chamber holes) was formed on the portion of the laminate opposite to the substrate where the molds do not exist, since Ti existing on the surface of the diaphragm layer has larger ionization tendency than the plating material (Ni), Ti was eluted at an early stage of the electroless plating. Meanwhile, Ni separated out on the surface of the diaphragm layer due to replacement reaction with Ti so as to become the nucleus for the growth of the plating, and the plating grew due to the nucleus.

In the ink jet head, similarly to the example 1, a thickness of the ink chamber member was 30 μm±1 μm, and the thickness was hardly different between the portion corresponding to the peripheral edge and the portion corresponding to the center of the silicon substrate. The ink chambers were charged with the ink, and pulse voltage whose maximum voltage was 20 V was applied between the individual electrode layers and the diaphragm layer with frequency of 20 kHz, so that the ink was discharged from the nozzle holes. When the discharge speed of the ink was measured, a difference in the discharge speed between the portion corresponding to the peripheral edge and the portion corresponding to the center of the silicon substrate was within 3%.

In the case where the diaphragm layer was composed of metal alloy of Pt and Mg or Al or Zn instead of the metal alloy of Pt and Ti, the same effect as that in the case of the metal alloy of Pt and Ti could be obtained.

EXAMPLE 6

In the example 6, like the example 2, a number of the nozzles per one inch was 720 which was twice as many as that in the example 4 or 5 (width of the side wall of the ink chamber member: 17.5 μm), and the other conditions were the same as those in the example 4 or 5.

When pulse voltage whose maximum voltage was 20 V was being applied between the individual electrode layers and the diaphragm layer of the piezoelectric element of the ink jet head with frequency of 20 kHz for ten days. As a result, brittle fracture did not occur on the side wall of the ink chamber member, and the diaphragm layer and the ink chamber member were not peeled, and defective discharge of the ink and deterioration of the discharge properties were not seen at all.

Comparative Example

Meanwhile, as the comparative example, the ink chamber member was formed not by the electroless plating but the electroplating, so that the ink jet head was manufactured.

Concretely, similarly to the example 1, the laminate was formed on the silicon substrate of 4 inches, and the molds with height of 50 μm, length of 2 mm and width of 35 μm were formed on the diaphragm layer of the laminate.

After the naturally oxidized layer on the portion on the surface of the diaphragm layer where the molds do not exist was removed by HCl, the laminate was put into the Ni plating tank heated to 50° C. so as to be subject to the electroplating. While the density of the plating was being adjusted, the laminate was electrified for one hour so that an electroplating layer was formed.

Similarly to the example 1, the molds were removed by the dry etching so that the ink chamber holes were formed. As a result, the ink chamber member composed of the electroplating material was obtained. When the thickness of the ink chamber member was measured, the thickness was 30 μm±10 μm, and thus it was found that the thickness was very different between the portion corresponding to the peripheral edge and the portion corresponding to the center of the silicon substrate.

Similarly to the example 1, the silicon substrate was removed, the nozzle plate was bonded to the surface of the ink chamber member opposite to the laminate, so that the individual electrode layers were patterned.

After the patterning was ended, the ink chambers were charged with the ink, and the voltage was applied between the individual electrode layers and the diaphragm layer, so that the ink was discharged from the nozzle holes. When the discharge speed of the ink was measured, a difference in the discharge speed between the portion corresponding to the peripheral edge and the portion corresponding to the center of the silicon substrate was 10%.

When the ink chamber member was formed by the electroplating, therefore, dispersion of the thickness of the ink chamber member becomes large. As a result, in the case where the many ink jet heads are manufactured together by using the substrate with large area like the 4-inch silicon substrate, the dispersion of the ink discharge properties occurs between the ink jet heads. When the ink chamber member is formed by the electroless plating like the examples 1 through 6, however, the thickness of the ink chamber member can be uniform, and the dispersion of the ink discharge properties between the ink jet heads can be suppressed.

What is claimed is:

1. A liquid discharge head, comprising:

liquid chambers for housing liquid;

a piezoelectric element configured so that a plurality of layers including a piezoelectric layer, an electrode layer and a diaphragm layer are laminated, the piezoelectric element being deformed to a laminating direction so that a capacity of the liquid chambers is reduced and discharging the liquid in the liquid chambers; and a liquid chamber member made of an electroless plating material provided on one side of the piezoelectric element in the laminating direction, the liquid chamber member having liquid chamber holes for composing the liquid chambers opened on a side of the piezoelectric element and a surface opposite to the piezoelectric element, wherein at least a part on the surface of the piezoelectric element on the side of the liquid chamber member is composed of a nucleus forming assistance material contained layer containing a material for assisting nucleus forming for growth of plating at the time of forming the liquid chamber member on the surface by means of the electroless plating;

wherein the nucleus forming assistance material contained layer is patterned correspondingly to a position of the liquid chamber member other than the liquid chamber holes.

2. A liquid discharge head, comprising:

liquid chambers for housing liquid;

a piezoelectric element configured so that a plurality of layers including a piezoelectric layer, an electrode layer and a diaphragm layer are laminated, the piezoelectric element being deformed to a laminating direction so that a capacity of the liquid chambers is reduced and discharging the liquid in the liquid chambers; and a liquid chamber member made of an electroless plating material provided on one side of the piezoelectric element in the laminating direction, the liquid chamber member having liquid chamber holes for composing the liquid chambers opened on a side of the piezoelectric element and a surface opposite to the piezoelectric element, wherein at least a part on the surface of the piezoelectric element on the side of the liquid chamber member is composed of a nucleus forming assistance material contained layer containing a material for assisting nucleus forming for growth of plating at the time of forming the liquid chamber member on the surface by means of the electroless plating;

wherein the entire surface of the piezoelectric element on the side of the liquid chamber member is composed of the nucleus forming assistance material contained layer.

3. The liquid discharge head of claim 2, wherein:

the diaphragm layer contains the material for assisting the nucleus forming, and the diaphragm layer serves also as the nucleus forming assistance material contained layer.

4. A method for manufacturing a liquid discharge head, the liquid discharge head having liquid chambers for housing liquid, and a piezoelectric element configured so that a plurality of layers including a piezoelectric layer, an electrode layer and a diaphragm layer are laminated, the piezoelectric element being deformed to a laminating direction so that a capacity of the liquid chambers is reduced and discharging the liquid in the liquid chambers, the manufacturing method comprising:

the laminate forming step of laminating at least the piezoelectric layer, the electrode layer and the diaphragm layer so as to form a laminate on a substrate;

the liquid chamber member forming step of forming a liquid chamber member on a surface of the laminate opposite to the substrate by means of electroless plating, the liquid chamber member having liquid chamber holes for composing the liquid chambers being opened on a side of the laminate and a surface opposite to the laminate; and the substrate removing step of removing the substrate after the liquid chamber member forming step;

wherein the liquid chamber member forming step includes:

the mold forming step of forming molds which are patterned correspondingly to a position of the liquid chamber holes of the liquid chamber member on the surface of the laminate opposite to the substrate;

the side wall forming step of forming a side wall of the liquid chamber holes on the liquid chamber member on a portion on the surface of the laminate opposite to the substrate where the molds do not exist by means of electroless plating; and the liquid chamber hole forming step of removing the molds after the side wall forming step so as to form the liquid chamber holes.

5. The method for manufacturing the liquid discharge head of claim 4, wherein at the mold forming step, the molds are formed by photosensitive resist.

6. The method for manufacturing the liquid discharge head of claim 4, wherein:

after the mold forming step, a nucleus forming assistance material contained layer containing a material for assisting nucleus forming for growth of the plating at the time of forming the liquid chamber member by means of the electroless plating is formed on a portion on the surface of the laminate opposite to the substrate where the molds do not exist, and at the side wall forming step, the side wall of the liquid chamber holes are formed on the nucleus forming assistance material contained layer by the electroless plating.

7. The method for manufacturing the liquid discharge head of claim 6, wherein the material for assisting the nucleus forming is metal having catalysis with respect to reduction reaction of a plating material.

8. The method for manufacturing the liquid discharge head of claim 7, wherein:

the plating material is Ni, and the metal having catalysis with respect to the reduction reaction of the plating material is at least one selected from a group of Ni, Fe and Pd.

9. The method for manufacturing the liquid discharge head of claim 6, wherein the material for assisting the nucleus forming is metal having larger ionization tendency than the plating material.

10. The method for manufacturing the liquid discharge head of claim 9, wherein:

the plating material is Ni, and the metal having larger ionization tendency than the plating material is at least one selected from a group of Ti, Mg, Al and Zn.

11. The method for manufacturing the liquid discharge head of claim 4, wherein:

at the laminate forming step, the entire surface of the laminate opposite to the substrate is composed of a nucleus forming assistance material contained layer containing a material for assisting nucleus forming for growth of the plating at the time of forming the liquid chamber member by means of the electroless plating, and at the liquid chamber forming step, the liquid chamber member is formed on the surface of the laminate opposite to the substrate by the electroless plating.

12. The method for manufacturing the liquid discharge head of claim 11, wherein at the laminate forming step, the entire surface of the laminate opposite to the substrate is composed of the diaphragm layer which contains the material for assisting the nucleus forming so as to serve also as the nucleus forming assistance material contained layer.

* * * * *